US011071359B2

(12) United States Patent
Green et al.

(10) Patent No.: US 11,071,359 B2
(45) Date of Patent: Jul. 27, 2021

(54) INTERCHANGEABLE JEWELRY

(71) Applicant: Style Dots LLC, Rockford, MI (US)

(72) Inventors: Karen L. Green, West Sacramento, CA (US); Gina M. Smith, Nixa, MO (US)

(73) Assignee: STYLE DOTS LLC, Rockford, MI (US)

( * ) Notice: Subject to any disclaimer, the term of this patent is extended or adjusted under 35 U.S.C. 154(b) by 336 days.

(21) Appl. No.: 15/745,676

(22) PCT Filed: Dec. 6, 2017

(86) PCT No.: PCT/US2017/064945

§ 371 (c)(1),
(2) Date: Jan. 17, 2018

(87) PCT Pub. No.: WO2018/106826

PCT Pub. Date: Jun. 14, 2018

(65) Prior Publication Data

US 2020/0100571 A1 Apr. 2, 2020

(51) Int. Cl.
*A44C 17/02* (2006.01)
*A44C 25/00* (2006.01)

(52) U.S. Cl.
CPC ..... *A44C 17/0225* (2013.01); *A44C 25/001* (2013.01)

(58) Field of Classification Search
CPC .. B25F 1/00; F25C 5/043; G04D 1/10; B25G 1/102; A44C 17/0225; A44C 17/0208; A44C 17/02; A44C 17/0216; A44C 25/001; A44C 5/00; A44C 9/0061; A44C 9/00; A44C 9/0038; A44C 9/02; A44C 5/0053

(Continued)

(56) References Cited

U.S. PATENT DOCUMENTS 697,120 A * 4/1902 Wade ..... G04D 1/10 81/6
901,333 A * 10/1908 Fitzgerald (Continued)

FOREIGN PATENT DOCUMENTS

WO WO-03079841 A1 * 10/2003 ..... A44C 9/0038

OTHER PUBLICATIONS

International Search Report and Written Opinion for application No. PCT/US2017/064945 dated Mar. 16, 2018.

(Continued)

*Primary Examiner* — Jack W Lavinder
(74) *Attorney, Agent, or Firm* — Workman Nydegger

(57) ABSTRACT

An interchangeable jewelry system or kit can include a jewelry base, one or more charms, and one or more keys. A manufacturer can configure the jewelry base so that a user can wear the jewelry system as a ring, necklace, bracelet, or any other type of jewelry. The jewelry base can include a recessed surround and a post recess. A manufacturer can size the charm to fit within the recessed surround and be configured in a variety of ways to lock into the recessed surround. A manufacturer can configure a key in a variety of ways so that a user can unlock the dot fitting from the recessed surround with the key. Once unlocked, the owner can remove the charm from the recessed surround of the jewelry base and can select an alternative dot fitting with a different design to lock into the recessed surround.

20 Claims, 5 Drawing Sheets

(58) Field of Classification Search
USPC ..... 63/29.1, 40; 81/8, 436, 439, 461, 16, 6
See application file for complete search history.

(56) References Cited

U.S. PATENT DOCUMENTS

| | | | |
|---|---|---|---|
| 1,052,141 | A | 2/1913 | Gaschke |
| 1,448,465 | A | 3/1923 | Sherman |
| D123,719 | S | 11/1940 | Ungar |
| D174,242 | S | 3/1955 | Warwick et al. |
| 3,831,398 | A | 8/1974 | Davis |
| 3,905,525 | A | 9/1975 | Kawamata |
| 4,959,890 | A | 10/1990 | Pazurek |
| 5,048,311 | A | 9/1991 | Mastrobuono |
| D326,827 | S | 6/1992 | Peterson |
| 5,357,659 | A | 10/1994 | Ackermann |
| D363,042 | S | 10/1995 | Papernik et al. |
| 5,505,061 | A | 4/1996 | Fleury et al. |
| 5,709,327 | A | 1/1998 | LaMacchia et al. |
| 5,794,459 | A | 8/1998 | Ignatowski |
| 6,544,164 | B1 | 4/2003 | Fan |
| D511,473 | S | 11/2005 | Weinacht |
| D539,698 | S | 4/2007 | Choi |
| D551,585 | S | 9/2007 | Wooley et al. |
| 7,980,095 | B1 | 7/2011 | Masterson |
| D657,281 | S | 4/2012 | Psaute |
| 8,429,934 | B2 | 4/2013 | Roessler |
| 8,650,723 | B2 | 2/2014 | Reiter |
| D713,755 | S | 9/2014 | Thompson |
| D714,181 | S | 9/2014 | Thompson |
| D723,409 | S | 3/2015 | Theodore et al. |
| D728,417 | S | 5/2015 | Pferdehirt |
| D728,419 | S | 5/2015 | Pferdehirt |
| D742,787 | S | 11/2015 | Schoenbeck et al. |
| D794,556 | S | 8/2017 | Liao |
| D803,716 | S | 11/2017 | Grainger |
| D810,608 | S | 2/2018 | Heller |
| D810,609 | S | 2/2018 | Heller |
| D835,809 | S | 12/2018 | Marshall |
| D838,208 | S | 1/2019 | Hirabayashi et al. |
| D861,535 | S | 10/2019 | Venables |
| D867,920 | S | 11/2019 | O'Connell |
| D872,606 | S | 1/2020 | Green et al. |
| D878,238 | S | 3/2020 | Holmes et al. |
| D886,658 | S | 6/2020 | Duncan et al. |
| 2001/0031443 | A1* | 10/2001 | Ferranti ..... A61C 3/00 433/141 |
| 2002/0073732 | A1 | 6/2002 | Masina et al. |
| 2004/0200236 | A1 | 10/2004 | Emberson et al. |
| 2005/0148809 | A1 | 7/2005 | Delaney |
| 2005/0166634 | A1 | 8/2005 | Silas et al. |
| 2006/0144083 | A1 | 7/2006 | Layton |
| 2011/0088428 | A1 | 4/2011 | Urban et al. |
| 2012/0131953 | A1 | 5/2012 | Fahsel |
| 2012/0240623 | A1 | 9/2012 | Morse |
| 2012/0324946 | A1 | 12/2012 | Latouf |
| 2013/0160489 | A1 | 6/2013 | Kourosh et al. |
| 2013/0263625 | A1 | 10/2013 | Taylor-Cattapan |
| 2015/0020543 | A1 | 1/2015 | Kaupp |
| 2015/0359301 | A1 | 12/2015 | Lavorato et al. |
| 2017/0317705 | A1 | 11/2017 | Duneier et al. |
| 2019/0098970 | A1 | 4/2019 | Stein |

OTHER PUBLICATIONS

Office Action for Canadian Application No. 2,998,583 dated, Jan. 15, 2020.

Non-Final Office Action for U.S. Appl. No. 16/723,906 dated, Feb. 19, 2020.

U.S. Appl. No. 15/932,446, dated Dec. 6, 2016, Style Dots, LLC.

Final Office Action received for U.S. Appl. No. 16/723,906, dated Jul. 7, 2020, 9 pages.

Notice of Allowance received for U.S. Appl. No. 16/723,906, dated Oct. 19, 2020, 5 pages.

Office Action received for Canadian Patent Application No. 2998583, dated Nov. 12, 2020, 4 pages.

Office Action received for Chinese Patent Application No. 201790001596.4, dated Jun. 16, 2020, 2 pages (Original Document only).

* cited by examiner

INTERCHANGEABLE JEWELRY

CROSS-REFERENCE TO RELATED APPLICATIONS

The present invention is a 35 U.S.C. § 371 U.S. National Stage of PCT Application No. PCT/US2017/064945, filed Dec. 6, 2017, which claims the benefit of U.S. Patent Application No. 62/430,756, filed on Dec. 6, 2016, and entitled INTERCHANGEABLE JEWELRY, the entire content which is incorporated herein by reference.

BACKGROUND OF THE INVENTION

Technical Field

Implementations of the present invention relate to jewelry, in particular customizable jewelry.

Background and Relevant Art

Jewelry wearers often purchase a wide range of rings, bracelets, or the like to provide a large variety of options for accenting an appearance. Of course, buying large amounts of jewelry can create cost and storage issues. The user may find this difficulty particularly problematic when the only difference among many of the jewelry items is found in just a portion of the ring or bracelet. For example, several rings may have different decorative elements, such as a mounted jewel or pattern, but similar base designs. In other cases, sometimes a person's physical dimensions, such as ring finger size, may change over time or in particular environments. This change can make the person's favorite jewelry item, in the form of a ring or bracelet, either too loose or too tight. The only option for the user in that case might be to take the jewelry to a dealer for resizing, or to remount the decorative element onto another base.

Conventional attempts to solve such problems involve options for interchanging decorative features of jewelry. In particular, the interchangeable jewelry market is becoming increasingly popular as jewelry wearers seek for a more cost effective means of accessorizing. Due to the wide variety of jewelry styles a user can presently purchase, a user might choose a particular jewel that matches a mood or outfit in order to match a certain desired aesthetic. In particular, it is common for users to change jewelry just to suit a particular outfit. One type of interchangeable jewelry system allows wearers to invest in a few base jewelry pieces (e.g., a ring, necklace, or bracelet) that have a cavity wherein a wearer can interchange different designs of jewels or charms. In such a system, the wearer need only purchase the interchangeable jewels or charms to have a diverse jewelry collection.

Such interchangeable jewelry systems, however, generally only require the wearer to press the jewel or charm into the cavity with their finger to secure it within the base jewelry piece, and lift it to remove the jewel or charm. Such an easy exchange creates the risk that the jewel or charm may not be completely secure within the cavity, and may fall out without the knowledge of the wearer. Even when this risk is accounted for with a detent-based locking mechanism, the wearer may be required to use a generic tool to remove the jewel or charm. Such tools tend to be universal to all jewels and charms used with that jewelry system. The tools add no additional design element to the jewelry collection, and add little extra security. Wearers of interchangeable jewelry may desire a level of security and customization for their jewelry that is not met with current methods employed by the given interchangeable jewelry system.

Accordingly, there are a number of difficulties in conventional jewelry, particularly where a wearer desires a high degree of customization.

BRIEF SUMMARY OF THE INVENTION

Implementations of the present invention comprise systems, kits, methods, and apparatus configured to enable users to easily replace decorative features of a jewelry item. In at least one implementation, an interchangeable jewelry system can include a base having a recessed surround, a charm configured to fit within the recessed surround of the base, and a key configured to remove the charm from the recessed surround of the base. The decorative features can be easily secured into a jewelry base to provide a secure attachment that provides the jewelry item with a high-end appearance, and that does not readily appear to be removable.

In one implementation, an interchangeable key for use with an interchangeable jewelry system can include a first gripping element, a jewelry release element, and a stop element. The first gripping element and the jewelry release element can both be sized and configured to fit within a post recess of a jewelry base that receives a removable charm. In such an implementation, the user can remove the charm by inserting the key from the bottom of the jewelry base to release the charm. The user can then depress another, different decorative feature into the jewelry base in such a way that the overall jewelry item again has an appearance of permanence and high quality.

In one implementation, an interchangeable jewelry kit can include a jewelry base, one or more interchangeable charms, and one or more keys. The jewelry base can comprise a recessed surround and a post recess extending through the base. The one or more interchangeable charms can fit in the recessed surround of the jewelry base to be secured thereto. A manufacturer can configure the one or more keys so that a user can insert a key through the post recess of the base and separate a specific charm, or a specific group of charms, from the recessed surround of the jewelry base.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above recited and other advantages and features of the invention can be obtained, a more particular description of the invention briefly described above will be rendered by reference to specific embodiments thereof, which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Implementations of the present invention comprise systems, kits, methods, and apparatus configured to enable users to easily replace decorative features of a jewelry item. In at least one implementation, an interchangeable jewelry system can include a base having a recessed surround, a charm configured to fit within the recessed surround of the base, and a key configured to remove the charm from the recessed surround of the base. The decorative features can be easily secured into a jewelry base to provide a secure attachment that provides the jewelry item with a high-end appearance, and that does not readily appear to be removable.

In one implementation, an interchangeable key for use with an interchangeable jewelry system can include a first gripping element, a jewelry release element, and a stop element. The first gripping element and the jewelry release element can both be sized and configured to fit within a post recess of a jewelry base that receives a removable charm. In such an implementation, the user can remove the charm by inserting the key from the bottom of the jewelry base to release the charm. The user can then depress another, different decorative feature into the jewelry base in such a way that the overall jewelry item again has an appearance of permanence and high quality.

In one implementation, an interchangeable jewelry kit can include a jewelry base, one or more interchangeable charms, and one or more keys. The jewelry base can comprise a recessed surround and a post recess extending through the base. The one or more interchangeable charms can fit in the recessed surround of the jewelry base to be secured thereto. A manufacturer can configure the one or more keys so that a user can insert a key through the post recess of the base and separate a specific charm, or a specific group of charms, from the recessed surround of the jewelry base.

Figure 1A:
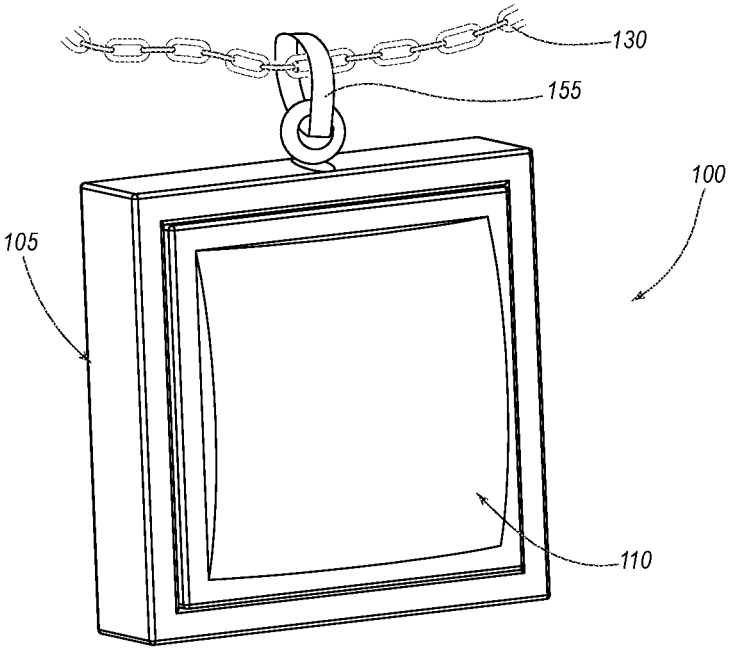
FIG. 1A illustrates an interchangeable jewelry system in accordance with one or more implementations of the present invention.

Accordingly, one will appreciate in view of the present specification and claims that implementations of the invention enable users to easily and securely interchange jewels in a secure and seamless manner. In particular, implementations of the present invention provide users with a wide range of customizations that, in at least one respect, enable a user to easily customize the visible parts of a jewelry item without requiring complete replacement of the jewelry item. Referring now to the figures, FIG. 1A illustrates an implementation of an interchangeable jewelry system 100 that includes a base 105 and a decorative element (or "charm") 110. In particular, FIG. 1A shows that an interchangeable jewelry system 100 can take the form of a necklace, wherein a connector 155 secures the jewelry system 100 onto a necklace chain 130. The jewelry system 100 can also include connectors that secure the jewelry system 100 to a bracelet or other jewelry item. Of course, one will appreciate that jewelry item 100 can take on many forms, including but not limited to rings, bracelets, earrings, or other types of known adornments, including clothing, belts, scarves, hats, and footwear that may incorporate one or more charms 110. As understood more fully herein, the jewelry system 100 generally comprises a jewelry base 105 into which a user can insert multiple different charms 110.

Figure 1B:
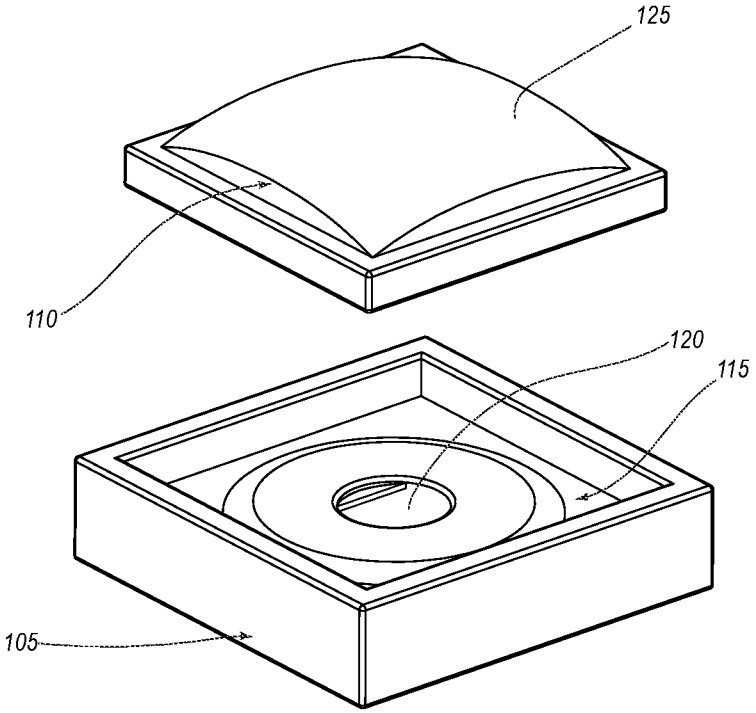
FIG. 1B illustrates an interchangeable jewelry system in accordance with one or more implementations of the present invention.

FIG. 1B shows the charm 110 and base 105 separated to further illustrate the relationship between the charm 110 and the base 105 of the interchangeable jewelry system 100 shown in FIG. 1A. A user can remove the charm 110 from the base 105, as shown, so that a different charm can be removably coupled to the base 105. The base 105 can include a number of features, including a recessed surround 115 and a post recess 120, that can geometrically mate with certain features of the charm 110 to hold them together. These and other features are described in more detail below in reference to FIGS. 2 through 4A. FIG. 4B, described in more detail below, shows how a user can remove the charm 110 from the base 105. Referring back to FIG. 1A, the edges of the charm/base alignment appear essentially seamless when a user joins them together.

One will appreciate that the base 105 and charm can also take several basic forms. For example, in addition to the foregoing square shapes of FIGS. 1A and 1B, an alternative implementation can comprise a rounded version of the base 105, and a set of rounded charms 110 that can be secured to the corresponding base 105. Beyond the outer perimeter shape variations, one will appreciate that the top face 125 of the charm 110 can include many different design forms. For example, charms 110 may comprising different decorative designs such as patterns, colors, letters, or pictures that include gems, stones, diamonds, various metals, and the like. The user can customize the interchangeable jewelry system 100 to include any number of charms 110 that the user desires.

In addition, while FIGS. 1A and 1B illustrate a generally square charm 110 and base 105, other implementations of an interchangeable jewelry system 100 can include other shapes. For example, in one implementation, the charm 110 and base 105 can be rounded or oval shaped. In another implementation, the jewelry system 100 can be triangular, polygonal, or otherwise irregularly shaped. One will appreciate that a manufacturer can achieve any number of shapes, sizes, and designs, while maintaining the interchangeability of the charm 110 with the base 105. Also, a manufacturer can use a variety of different materials, or combinations thereof, to construct the jewelry system 100. For example, a manufacturer can construct an interchangeable jewelry system 100 using cast iron, aluminum, brass, gold, plastics, rubbers, or other suitable materials generally used in jewelry construction.

Figure 2:
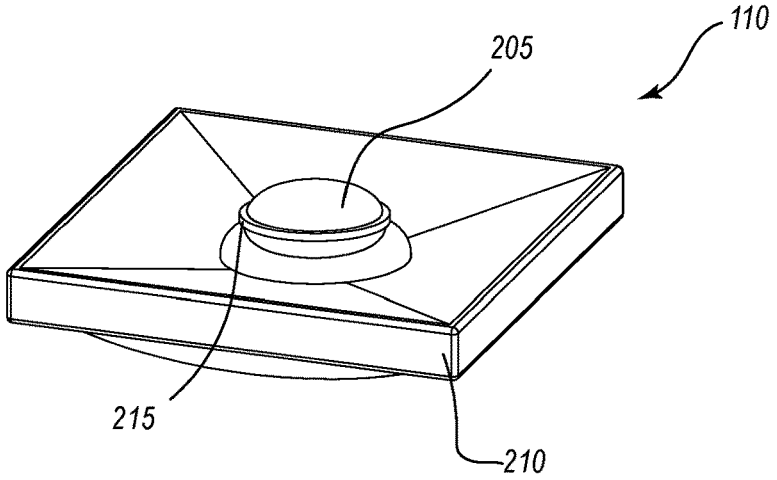
FIG. 2 illustrates a bottom perspective view of a charm of an interchangeable jewelry system in accordance with one or more implementations of the present invention.

Referring back to the figures, FIGS. 2 through 5B illustrate the various components of an implementation of an interchangeable jewelry system 100, similar to that shown in FIGS. 1A and 1B, as well as how a user can removably secure a base 105 and charm 110 together. To aid in the releasable connection between the charm 110 and base 105, a manufacturer can configure the joining elements and/or recesses with any number of appropriate configurations for a secure connection. FIG. 2 shows one such configuration that includes a post 205.

FIG. 2 illustrates a bottom view of a charm 110 that includes a post 205 protruding therefrom. A manufacturer can make the post 205 at least partially curved, substantially spherical, or otherwise shaped so as to coincide with the shape of the post recess 120 of the base. In this configuration, a user can insert the post 205 into the post recess 120 of the base 105. A manufacturer can configure the curvature of the post 205, or other features of the charm 110, to reciprocate with one or more curves or other detents formed within the base 105 to secure the charm 110 within the base 105. For example, a manufacturer can form the outer edge 210 of the charm 110 to fit within the recessed surround 115 of the base 105 so that the recessed surround 115 and the edge 210 of the charm 110 form a friction fit. The post 205 can also form a friction fit within the post recess 120 of the base.

FIG. 2 illustrates a post 205 that is curved, but other implementations of the charm 110 can include posts of various shapes and sizes. For example, a manufacturer can form a cylindrical post 205 that can correspond to a cylindrical post recess 120 of a similar size and shape. Also for example, a manufacturer can form a square or rectangular post 205 to coincide with a square or rectangular post recess 120 of the base 105. One will appreciate that a manufacturer can form a post 205 in any desired shape so long as a user can fit the post 205 securely in the post recess 120 of the base 105 and establish a friction fit between the charm 110 and the base 105.

Figure 3A:
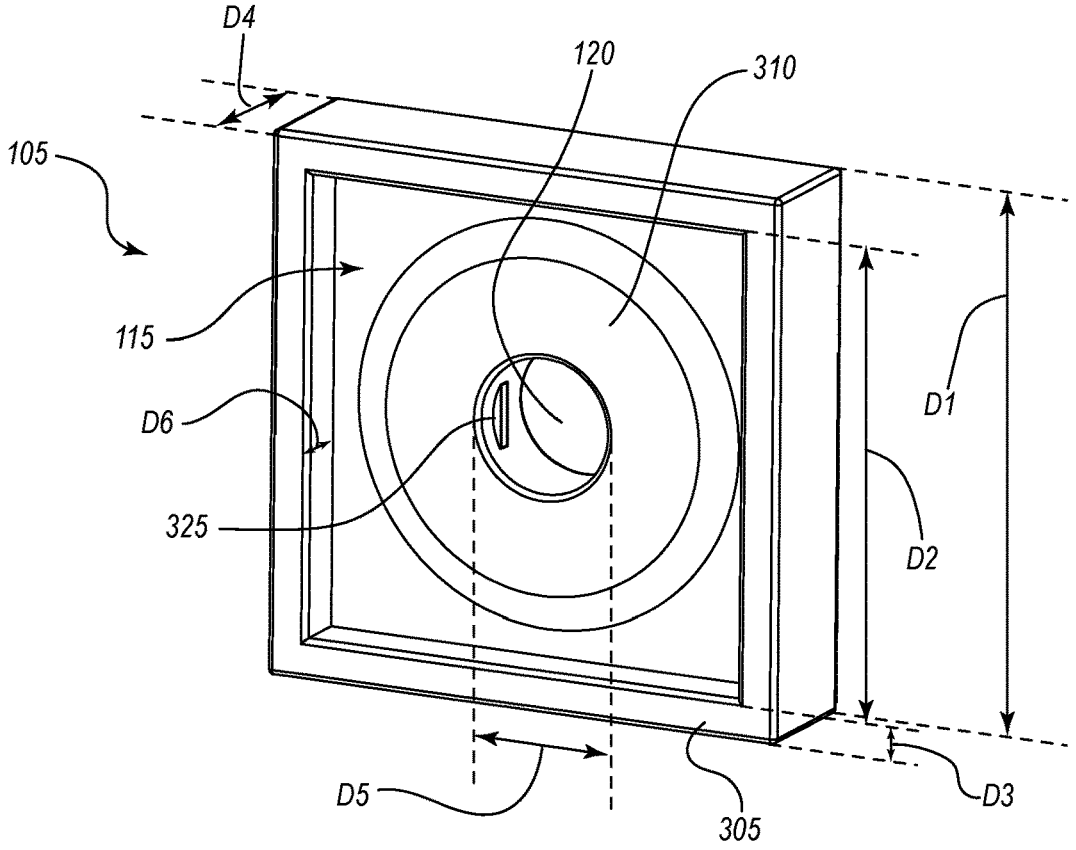
FIG. 3A illustrates a top perspective view of a base of an interchangeable jewelry system in accordance with one or more implementations of the present invention.
Figure 3B:
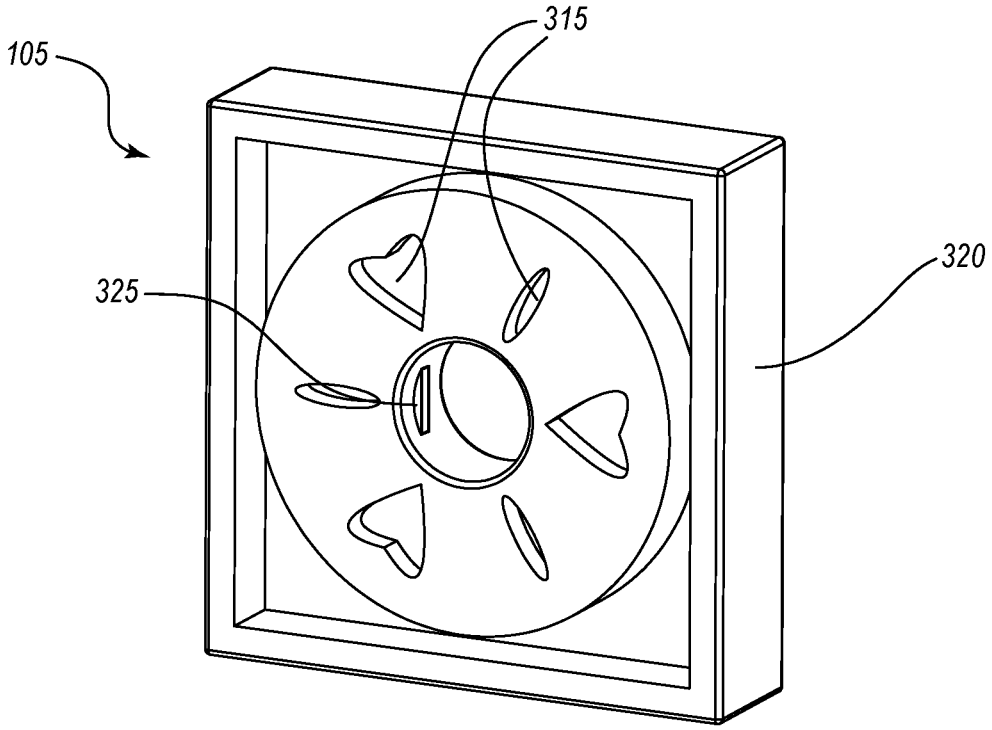
FIG. 3B illustrates a bottom perspective view thereof.
Figure 4:
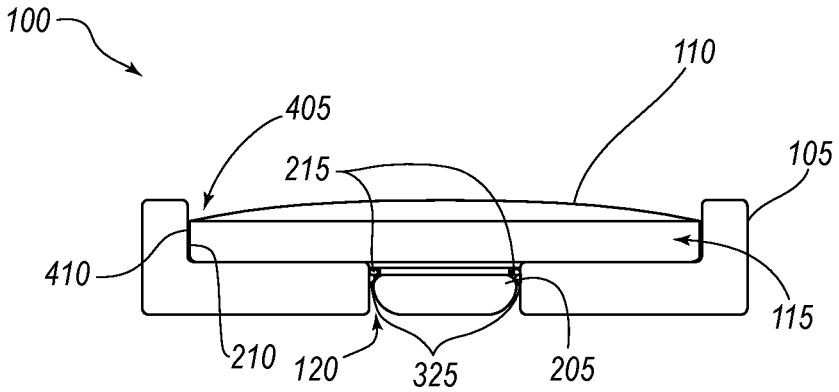
FIG. 4 illustrates a cross-sectional view of an interchangeable jewelry system in accordance with one or more implementations of the present invention.

Along these lines, FIGS. 3A through 4A show various features, such as the post recess 120 and the recessed surround 115 of the base 105, that coincide with the edge 210 and post 205 of the charm 110, to form the friction fit described above. FIG. 3A shows a bottom perspective view of one implementation of a base 105 that includes a recessed surround 115 and a post recess 120. The post recess 120 can include one or more pins 325 raised from, and extending laterally across, the inside surface of the post recess 120. The pins 325 can allow a user to "snap" the charm 110 into the base 105 and help form a friction fit between the post 205 of the charm 110 and the post recess 120 of the base 105, as will be described in more detail below.

FIG. 3A further shows one implementation of a base 105 comprising an outer length or width D1 of about 16 mm, and an inner length/width D2 of about 14 mm, wherein the length or width is defined by a set of side walls 305 having a thickness D3 of about 1 mm. FIG. 3A also shows that at least one implementation of the base 105 can have a height or depth D4 from top to bottom of about 4.5 mm. In this implementation, the diameter D5 of the post recess 120 can be about 5 mm. Other implementations of a base 105 can include various other dimensions.

For example, a manufacturer can form a base 105 in which the side walls are about 0.8 mm thick. This implementation can include a charm 110 and/or base 105 width/length D1 of about 16 mm so that an inner length/width D2 is about 14.4 mm. In this implementation, the manufacturer can form the post recess 120 with a diameter D5 of about 5.5 mm. In any of the implementations described herein, the manufacturer can form the base 105 so that an inner wall height D6 is about 1.5 mm and an inner circular feature 310 surrounding the post recess 120 has a diameter of about 12 mm. A manufacturer can form the charm 110 to include a complimentary circular feature on the bottom face of the charm 110 to correspond in shape with the circular feature 310 of the base 105. The inner circular feature 310 can be toroidal, conical, dome shaped, or the like.

One can also appreciate that a manufacturer can form the base 105 and/or charm 110 into other shapes, such as circular, as described above. In one circular implementation of the base 105, a manufacturer can form the base 105 with an outer diameter of about 14 mm, a wall thickness of about 1 mm, and a post recess diameter of about 5 mm. In another circular implementation, the manufacturer can form the base to have a post recess diameter of about 5.5 mm. In yet another circular implementation, the manufacturer can form the base 110 to have an outer diameter of 32 mm, an inner diameter of about 30 mm, a wall thickness of about 1 mm, and a post recess diameter of about 9 mm. In this embodiment, the base 110 can have an inner wall height of about 2.5 mm.

Of course, one will appreciate that different sizes and dimensions are possible with any of the implementations described herein without departing from the spirit of the invention.

Turning now to the other side of the base 105, FIG. 3B shows a bottom perspective view of the implementation of the base 105 shown in FIG. 3A. The bottom side of the base 105 can include a plurality of cutouts 315. A manufacturer can remove material from one or more surfaces of the bottom of the base 105 to create decorative patterns or designs. For example, as shown in FIG. 3B, the manufacturer can provide a pattern of hearts and eyelet shapes for aesthetic purposes. To this end, the manufacturer can include any number of various shapes and patterns of cutout material. For example, the manufacturer can include similar cutout patterns or designs in one or more side surfaces 320 of the base 105.

Figure 5A:
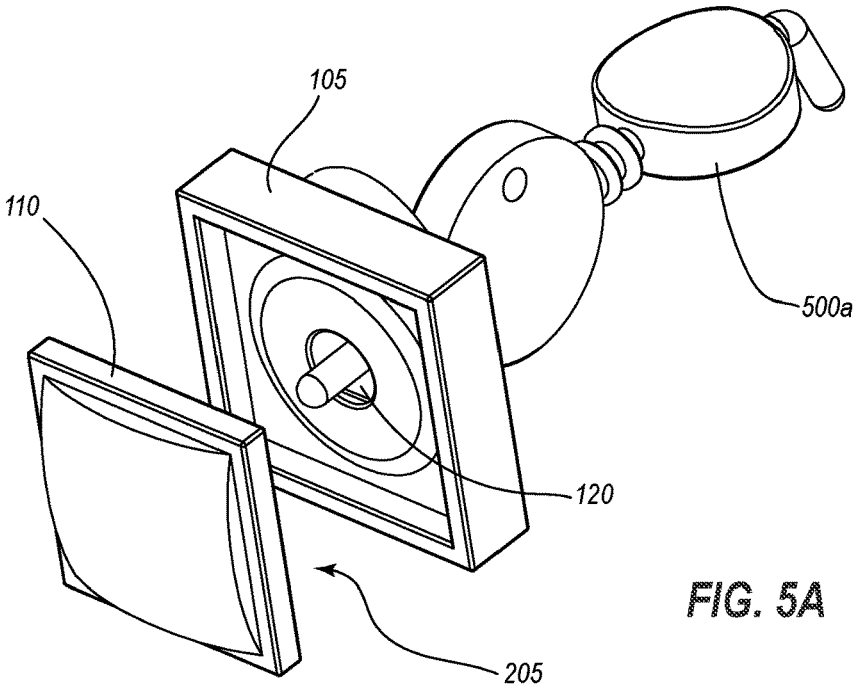
FIG. 5A illustrates a perspective view of a key separating a charm from a base in accordance with one or more implementations of the present invention.

FIGS. 1B through 3B all show various aspects and features of the base 105 and charm 110 of one or more implementations of an interchangeable jewelry system 100. The features described, such as the post 205, post recess 120, and recessed surround 115, among others, can all serve to provide a friction fit between a base 105 and charm 110. FIGS. 4 and 5A serve to shed light on how a user can secure the base 105 and charm 110 together and also detach the charm 110 from the base 105. For example, FIG. 4 shows a cross-sectional view of an implementation of an interchangeable jewelry system 100 similar to the system shown in FIG. 1A.

In this implementation, a user can insert the charm 110 into the recessed surround 115 of the base 105 so that the post 205 resides within the post recess 120. Various surfaces of the base 105 and charm 110 can contact each other to create a friction fit that holds the charm 110 and base 105 together. For example, an interface 405 between the edge 210 of the charm 110 and an inner wall surface 410 of the base 105 can provide at least part of the friction that holds the base 105 and charm 110 together. Also, friction between the post 205 and post recess 120 contacting one another can help secure the charm 110 to the base 105. The user can secure the charm 110 and base 105 together by simply pressing them towards one another with the user's fingers.

The implementations of the jewelry system 100 described herein, including the implementation shown in FIG. 4, can provide a simple, streamlined configuration that minimizes the total volume of the jewelry system 100 when the user inserts the charm 110 completely into the recessed surround 115 of the base 105. FIG. 4 in particular shows an implementation that allows a user to push the charm 110 and base 105 together simply and with only the use of the users two hands, or even one hand.

In some implementations, a manufacturer can include one or more detents on various surfaces of the base 105 and charm 110 to increase the surface area in contact between the charm 110 and base 105. Detents can include grooves on the various surfaces of the base 105 and charm 110 where the manufacturer can add or remove material from the surfaces. For example, FIGS. 3A, 3B, and 4 illustrate a pair of pins 325 disposed on the inside surface of the post recess 120 of the base 105. FIG. 4 illustrates a cross-sectional view of the pins 325.

A manufacturer can form the pins 325 using a flexible material, such as rubber, plastic, or other elastomeric material, so that the pins 325 flex downward when a user inserts the post 205 into the post recess 120. Once the user fully inserts the post 205 into the post recess 120, a space forms between the post 205 and post recess 120 that allows the pins 325 to flex back into their original position. To this end, FIG. 4 shows a fully inserted post 205, with pins 325 that are returned into their original position. In this way, the pins 325 can allow a user to "snap" the post 205 into the post recess 120 beyond the pins 325. The pins 325 can add resistance to a user removing the post 205 from the post recess 120 and provide an enhanced friction fit between the charm 110 and the base 105.

The pins 325 illustrated in FIGS. 3A through 4, and discussed above, can vary in size, shape, and quantity in other embodiments. FIGS. 3A through 4 show two pins 325 disposed on opposite sides of the post recess 120, but other embodiments can include more or less than two pins 325. For example, one embodiment may include three or more pins 325 disposed around the circumference of the post recess 120. In some embodiments, the pins 325 can be rounded or have straight edges. Also, various embodiments can include pins 325 that extend from the inside surface of the post recess 120 to varying distances. The more pins 325 provided, and the further those pins 325 extend away from the inside surface of the post recess 102, the greater the resistance provided by the pins 325 will be, and vice versa.

Also for example, in some embodiments, a manufacturer can remove material from the inner wall surface 410 of the base 105 to form a grooved detent. The manufacturer can add a ridge of material to the edge 210 of the charm 110 to form a detent on the charm 110 that corresponds in position with the detent on the base 105 when a user pushes the base 105 and charm 110 together.

A manufacturer can also form one or more detents, whether grooves formed by removing material or ridges formed by adding material, to the post 205 and post recess 120. Thus, when depressed by the user, the charm 110 detents (not shown) can expand into detents of the base 105, and thus help secure the charm 110 along with any other connection mechanisms illustrated or understood from the specification and figures herein. In one or more implementations, a manufacturer can create detents in the form of rings of material (not shown) extruding from the inner wall surface 410 of the base 105 and the edge 210 of the charm 110. One will appreciate that a manufacturer can add any number of features similar to detents, including the grooves and ridges described herein, as well as other features that aid in holding the charm 110 and base together 105 via friction.

As a result, in one or more implementations, a user cannot overcome the friction force holding the charm 110 and base 105 together by simply pulling the charm 110 and base 105 apart using fingers. Similarly, the user may not be able to grip the charm 110 and base 105 well enough once the user secures the charm 110 and base 105 together to create the force necessary to separate them. To this end, the interchangeable jewelry system 100, and various implementations of the system described herein, can include a key 500*a* that a user employs to separate the charm 110 and base 105.

Along these lines, FIG. 5A shows how a user can remove a charm 110 from a base 105 in accordance with an implementation of the present invention. FIG. 5A shows a perspective view where the key 500*a* protrudes into the post recess 120 and releases the charm 110 from the base 105. A user can insert the key 500*a* into the post recess 120 from the bottom of the base 105 and push the post 205 out of the post recess 210, thus separating the charm 110 from the base 105. The implementations of FIGS. 4 and 5, as well as other implementations described herein, provide the user with a simple and easy separation method. That is, the user can separate the charm 110 and base 105 with minimal effort or coordination using only two hands. For example, all the user needs to do is hold onto the base 105 with one hand, and push on the post 205 through the post recess 120 using the key 500*a*. The user does not need to grab or otherwise manipulate the charm 110 during the separation.

Figure 5B:
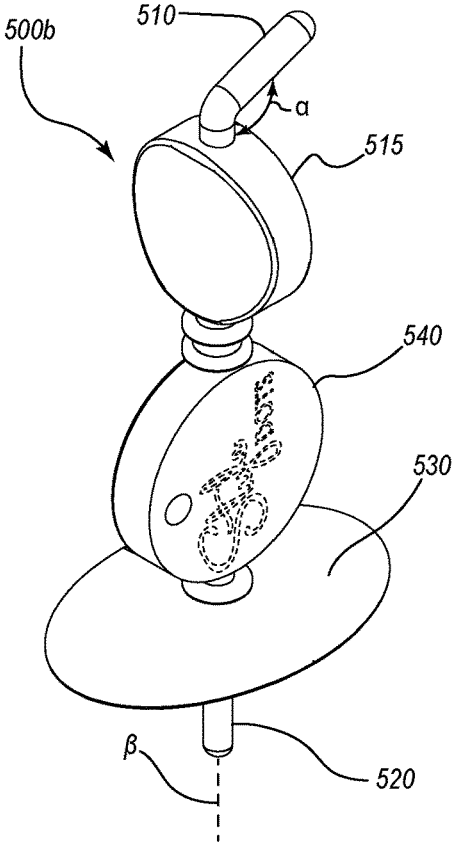
FIG. 5B illustrates a perspective view of a key in accordance with one or more implementations of the present invention.
Figure 5C:
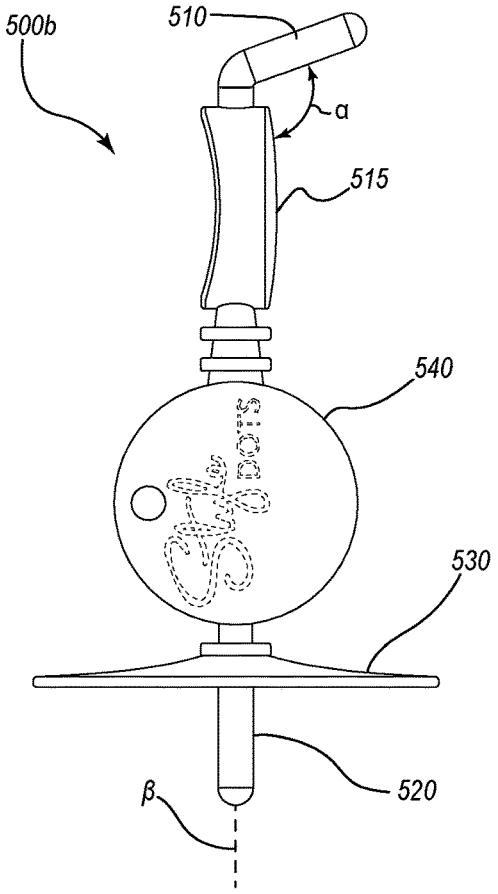
FIG. 5C illustrates a side view thereof.
Figure 6A:
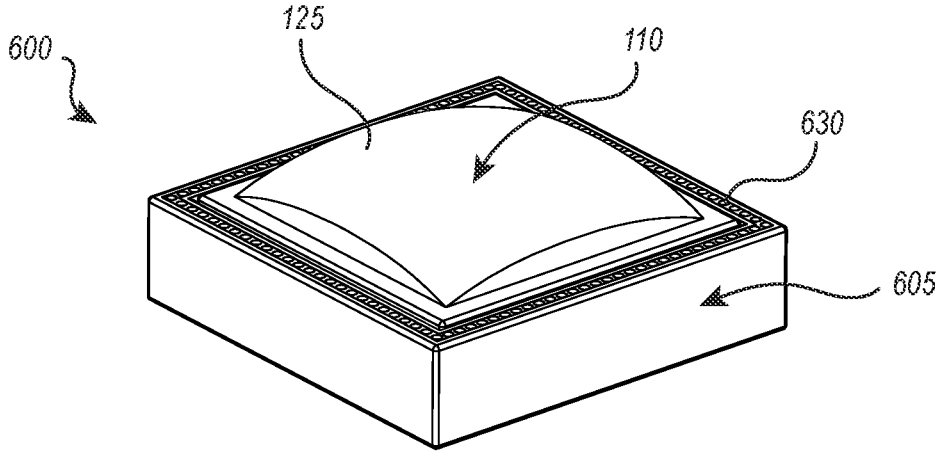
Figure 6B:
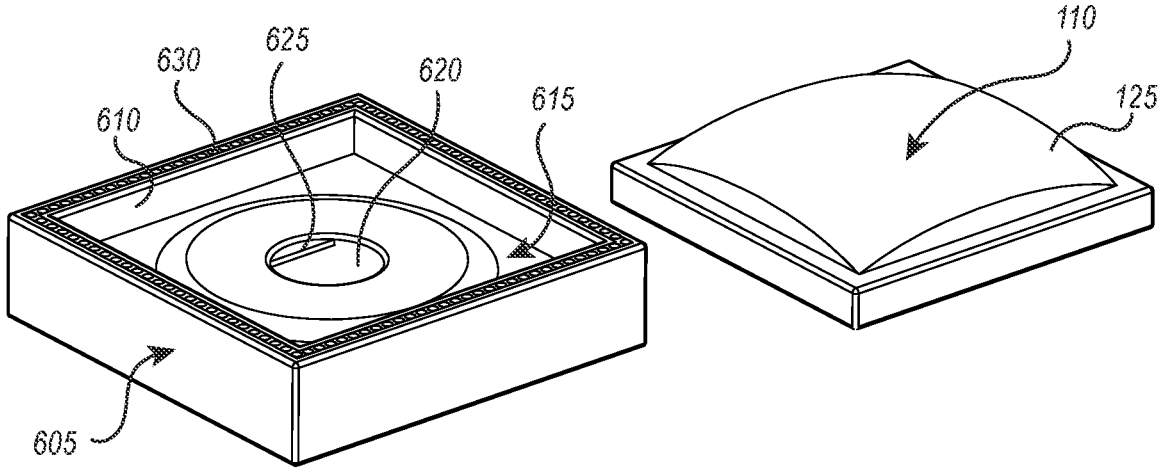

The key 500*a* can include various features in multiple implementations described herein. For example, FIGS. 5B and 5C shows one such implementation of a key design for use in accordance with implementations of the present invention. FIG. 5B shows a perspective view of a key 500*b* and FIG. 5C shows a side view of the key 500*b*. In general, a key 500*b* can comprise a first gripping element 510, a second release element 515, and a charm release element 520. A manufacturer can form the second gripping element 515 to be slightly curved and/or grooved on one or more sides to provide a surface that is complimentary to the finger of a user for gripping.

FIGS. 5B and 5C show one implementation of a key 500*b* where the first gripping element is pointed at an angle $\alpha$ away from the main axis $\beta$ of the charm release element 520 and key 500*b* in general. In some implementations, a manufacturer can form the key 500*b* so that the angle $\alpha$ varies between 90 to 180 degrees. For example, a manufacturer can form the first gripping element 510 so that the angle $\alpha$ is 90 degrees, resulting in the first gripping element 510 being perpendicular to the charm release element 520. Also, for example, a manufacturer can form the key 500*b* so that the first gripping element 510 is disposed coaxial with the charm release element 520, the angle $\alpha$ being 180 degrees. One will appreciate that a manufacturer can form the key 500*b* so that the angle $\alpha$ is anywhere between 90 and 180 degrees, greater than 180 degrees, or less than 90 degrees.

In one or more implementations, such as the implementation illustrated in FIGS. 5B-C, a manufacturer can configure the first gripping element 510 to have dimensions to also serve as a jewelry release portion. The key 500*b* can further include a stop element 530. The manufacturer can configure the stop element 530 to prevent the key 500*b* from extending through the base 105 beyond the stop element 530 when a user inserts the charm release element 520 into the post recess 120 to remove the charm 110. In additional or alternative implementations, the key 500*b* can include a design element 540.

In addition, one will appreciate that the gauge and thickness of the first gripping element 510 and/or release element 520 can vary as needed to correspond to the wide variety of potential circumference dimensions of the post recess 120 of the bases 105 described herein. For example, the first gripping element 510 and/or release element 520 can be the same size, or can be any one of the following sizes of 2.6 mm, 4.5 mm, 5 mm, 5.5 mm, 9 mm, or 9.5 mm, or just less than that to fit within the 3 mm, 5 mm, 5.5 mm and/or 9 mm, 9.5 mm post recesses 120 shown or described herein. The first gripping element 510 and/or release element 520 can have a cross-sectional shape similar to the shape of the post recess 120 in the base 105 so that a user can insert the release element 520 and/or first gripping element 510 through the post recess 120.

Accordingly, one will appreciate that a wide variety of alternate implementations are possible within the spirit and scope of the present invention. For example, the gauge and thickness of the first gripping element 510 and/or release element 520 can vary as needed to correspond to the wide variety of potential circumference dimensions of the post recess 120 of the base 105. For example, the gripping element 510 and/or release element 520 can be the same size, or can be any one of the following sizes of 5 mm, 5.5 mm, 9 mm, or 9.5 mm, or just less than that to fit within the 5 mm, 5.5 mm and/or 9 mm, 9.5 mm cavities/recesses shown or described above.

In the illustrated implementation, the stop element 530 comprises an approximately oval design. A manufacturer can form stop elements 530 in other key designs that are other shapes, such as round, square, rectangular, or otherwise polygonal or irregularly shaped, so long as the stop element 530 stops the key 500*b* from inserting through the base 105 beyond the stop element 530 once the user releases the charm 110 from the base 105. The stop element 530 can protect the user from jamming fingers into the base 105 when pushing the charm 110 away with the key 500*b*.

In one or more implementations, a manufacturer can form a key with no stop element 530. In one implementation, a manufacturer can form a key with no second gripping element 515. Further along these lines, different key designs for use in accordance with implementations of the present invention can include, among other things, a wide variety of style elements.

In addition, one will appreciate that elements of the present invention can be used as a kit. In one implementation, for example, a kit for customizing jewelry can comprise one or more jewelry elements, each of which comprises a form of a base 105 and a plurality of charms 110. In one implementation, the kit comprises a base 105 and charms 110 that are squared, or alternatively only those that are rounded. In additional or alternative implementations, the kits comprise a mixture of squared and rounded versions of the base and charms. In still further implementations, the kit comprises one or more keys of differing possible designs such as those shown in FIGS. 5A-5C. The keys can correspond in size and shape to fit within a post recess 120 for inserting and releasing a charm 110 into and out of a base 105.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

We claim:

1. An interchangeable jewelry system comprising:

a base comprising a recessed surround and a post recess extending entirely through the base;

a charm configured to fit within the recessed surround of the base, the charm comprising:

a top side;

a bottom side;

a post extending from the bottom side of the charm, wherein the post recess of the base is configured to receive the post;

wherein the charm and base are held together by a friction fit between the post and the post recess; and a key configured to extend through a bottom side of the base and remove the charm from the recessed surround of the base.

2. The interchangeable jewelry system of claim 1, wherein the post is substantially spherical.

3. The interchangeable jewelry system of claim 1, the base further comprising a side wall extending around a perimeter of the base from a top side of the base, the side wall having an inner surface.

4. The interchangeable jewelry system of claim 3, the charm further comprising an outer edge, wherein the outer edge of the charm and the inner surface of the side wall are similarly shaped so as to make contact when the charm is inserted into the recessed surround of the base, wherein a friction fit between the outer edge of the charm and the side wall at least partially holds the charm and the base together.

5. The interchangeable jewelry system of claim 1, wherein the key comprises:

a first gripping element;

a charm release element configured to be inserted through the base to push the charm out of the recessed surround of the base; and a stop element configured to prevent the key from being inserted all the way through the base.

6. The interchangeable jewelry system of claim 5, the key further comprising a second gripping element configured to aid a user in maintaining a firm grip on the key when removing the charm from the recessed surround of the base.

7. The interchangeable jewelry system of claim 5, wherein the first gripping element is configured to be inserted through the base to push the charm out of the recessed surround of the base.

8. An interchangeable key for use with interchangeable jewelry comprising:

a first end and an opposing second end;

a first gripping element disposed on the first end;

a stop element disposed on the opposing second end; and a jewelry release element extending from the stop element in a direction opposite the first end;

wherein both of the first gripping element and the jewelry release element are sized and configured to fit within and extend through a post recess of a jewelry base, the jewelry base being for use on a jewelry item that receives a removable charm, wherein the stop element comprises a flange extending radially outward and substantially perpendicular to the jewelry release element, the stop element configured to protect one or more fingers of a user when inserting the jewelry release element into the post recess of the jewelry base.

9. The interchangeable key for use with interchangeable jewelry of claim 8, the interchangeable key further comprising a second gripping element.

10. The interchangeable key for use with interchangeable jewelry of claim 9, the second gripping element further comprising a concave curved surface configured to provide grip to a finger of a user.

11. The interchangeable key for use with interchangeable jewelry of claim 8, wherein the first gripping element is disposed at an angle relative to the jewelry release element.

12. The interchangeable key for use with interchangeable jewelry of claim 11, wherein the angle is between 90-degrees and 180-degrees.

13. An interchangeable jewelry kit comprising:

a jewelry base comprising a recessed surround and a post recess extending through the base;

one or more interchangeable charms each configured to fit in the recessed surround of the jewelry base, wherein each charm comprises a post extending from a bottom surface of the charm, the post configured to extend through the post recess of the base and hold the charm in the recessed surround of the jewelry base via friction between the post and post recess; and one or more keys configured to be inserted through the post recess of the base and separate a specific charm or a specific group of charms from the recessed surround of the jewelry base.

14. The interchangeable jewelry kit of claim 13, wherein the post is substantially spherical.

15. The interchangeable jewelry kit of claim 13, wherein the post recess is circular in shape and has a diameter that is between about 5 mm to about 9.5 mm.

16. The interchangeable jewelry kit of claim 13, wherein the jewelry base is configured with a height of about 4.8 mm to about 6.5 mm and a total outer diameter of about 14 mm to about 30 mm.

17. The interchangeable jewelry kit of claim 13, wherein the jewelry base further comprises a side wall extending around a perimeter of a top surface of the jewelry base, the side wall having a thickness of about 1 mm, and wherein a total outer diameter of the jewelry base is about 14 mm to about 32 mm.

18. The interchangeable jewelry kit of claim 13, where the each of the one or more keys comprises:

a first gripping element;

a charm release element configured to be inserted through the base to push the charm out of the recessed surround of the base; and a stop element configured to prevent the key from being inserted all the way through the base.

19. The interchangeable jewelry kit of claim 18, the key further comprising a second gripping element configured to aid a user in maintaining a firm grip on the key when removing the charm from the recessed surround of the base.

20. The interchangeable jewelry kit of claim 18, wherein the first gripping element is configured to be inserted through the base to push the charm out of the recessed surround of the base.

* * * * *